United States Patent [19]

Allio et al.

[11] Patent Number: 4,623,140

[45] Date of Patent: Nov. 18, 1986

[54] APPARATUS FOR THE DEFLECTING AND STACKING OF LETTERS AND THE LIKE

[75] Inventors: Roland Allio; Gilbert Del Fabbro; François Debrabant; Francois Gillet, all of Paris, France

[73] Assignee: Hotchiss-Brandt-Sogeme-H.B.S., Paris, France

[21] Appl. No.: 461,492

[22] Filed: Jan. 27, 1983

[30] Foreign Application Priority Data

Feb. 19, 1982 [FR] France ..... 82 02793

[51] Int. Cl.[4] ..... B65H 39/10

[52] U.S. Cl. ..... 271/305; 271/177; 271/198; 271/215; 271/219

[58] Field of Search ..... 271/297, 305, 198, 215, 271/217, 219, 177–180, 145, 149, 198; 209/584

[56] References Cited

U.S. PATENT DOCUMENTS

| | | | |
|---|---|---|---|
| 2,933,314 | 4/1960 | Stobb | 271/215 |
| 3,149,836 | 9/1964 | Ragozzino | 271/219 |
| 3,224,760 | 12/1965 | Smith . | |
| 3,252,570 | 5/1966 | Smith | 271/305 |
| 3,674,143 | 7/1972 | Hunter | 271/305 X |
| 3,918,700 | 11/1975 | Donner | 271/217 X |
| 4,012,036 | 3/1977 | Sokol | 271/215 |
| 4,245,833 | 1/1981 | Akerstrom | 271/198 |

FOREIGN PATENT DOCUMENTS 720640 12/1954 United Kingdom .

*Primary Examiner*—Richard A. Schacher

*Attorney, Agent, or Firm*—Cushman Darby & Cushman

[57] ABSTRACT

The invention relates to an apparatus for deflecting and stacking letters and the like.

Such an apparatus comprises a support plate which, with the horizontal, forms an angle of 23° and has at least one belt driven by motor means, at least one second belt driven by friction by the first belt and which in turn drives at least one further belt. A deflecting means placed in a deflection position by a control means deflects the letters towards a stacker, constituted by a pallet sliding under the action of the stack of letters during formation along a shaft.

6 Claims, 2 Drawing Figures

APPARATUS FOR THE DEFLECTING AND STACKING OF LETTERS AND THE LIKE

BACKGROUND OF THE INVENTION

The present invention relates to an apparatus for deflecting and stacking letters and the like.

Known stackers require the use of relatively complicated control systems in order that such an apparatus functions correctly, it is necessary for the introduction of the letters and the correct formation of the stack to take place simultaneously.

BRIEF SUMMARY OF THE INVENTION

The problem of the present invention is to obviate these disadvantages and more specifically relates to a very simple deflecting and stacking apparatus for letters and the like, which permits the stacking of flat objects over a significant length, without involving the use of costly logic and control equipment.

It specifically relates to an apparatus for the deflecting and stacking of letters and the like for the purpose of sorting and storing letters as a function of their destination, said letters being transported by means of at least one main transfer path, wherein it comprises at least one means for orienting the letter from this main transfer path to at least one deflecting path issuing at at least one stacker, where the letters are packed tight by a pallet, all the means being carried by a support plate.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

The same elements carry the same references in all the drawings.

Figure 1:
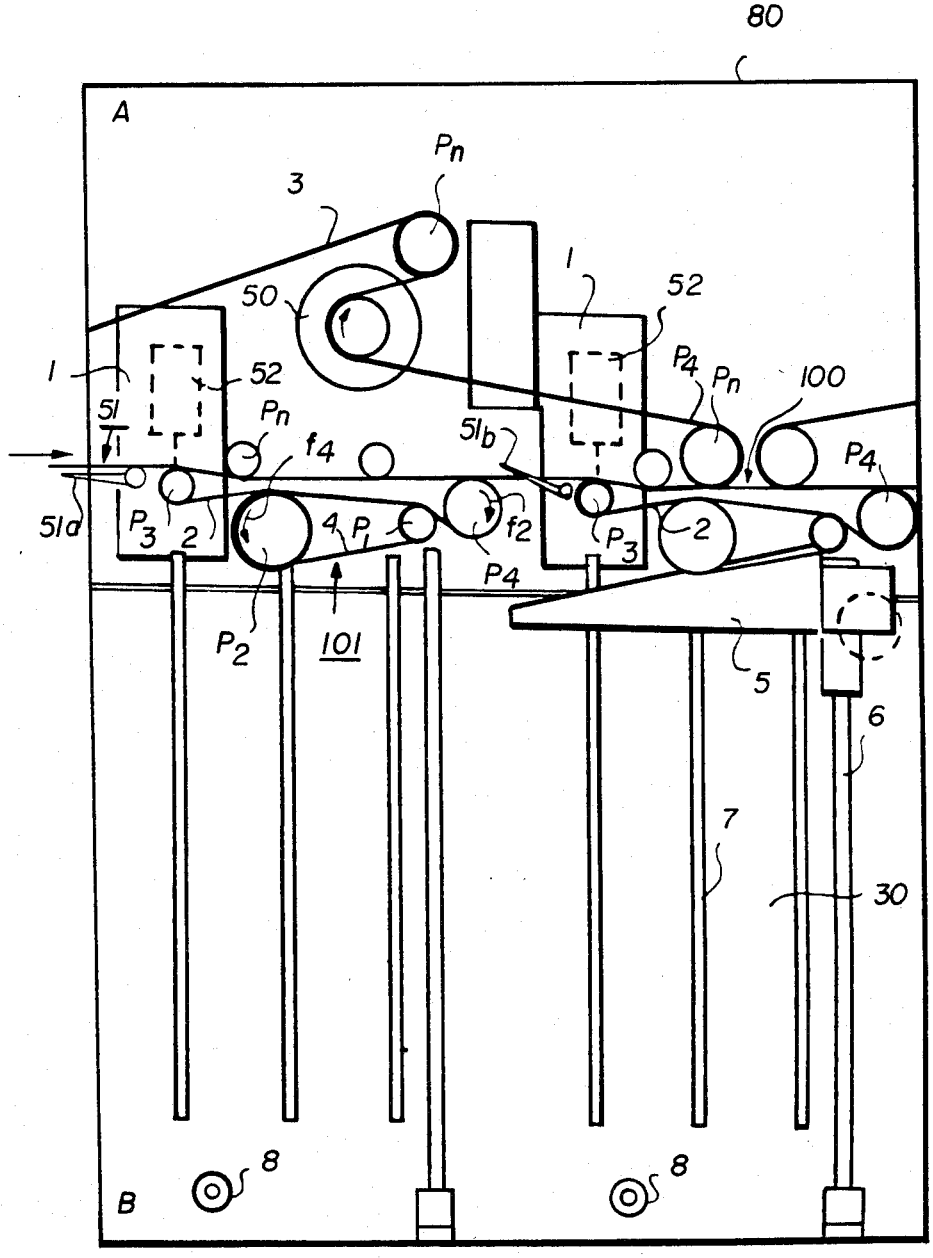
FIG. 1 a diagrammatic representation of an apparatus according to the invention.

According to FIG. 1, an apparatus according to the invention essentially comprises a deflecting means, which extracts the letters from the conveying system in order to guide them towards a stacker 30, which is inclined in order to benefit from the inertia of the letters. A pallet or tight packing means 5 moves automatically along a shaft 6 towards the bottom of stacker 30 under the effect of the weight of the stack and the kinetic energy of the last letter entering the stacker 30, whilst maintaining the stack compressed as a result of a calibrated return spring (not visible in the drawing), which tends to oppose the displacement thereof. The plane of support plate 80 forms a given angle $\alpha$ with the horizontal, which makes it possible to use the gravity effect and offer the operators good accessibility for emptying the stacker. This angle is preferably 23°. Thus, the plate has a so-called upper part (A) and a so-called lower part (B). The gravity effect can be optimized by means of strips 7 offering the lower part of the letters, a weak contact surface combined with a weak friction coefficient inherent in the choice of material. For example, it is possible to use nylon strips.

The conveying system 100 is a belt system. The letters are squeezed between the belts in the manner described hereinafter. The first belt 3 is called the drive belt and is formed by an endless belt rotating about a set of pulleys Pn and driven by motor means 50. The first belt 3 cooperates with a second endless belt 2, rotating between two pulleys P3 and P4. The second belt 2 is driven by friction by the first belt 3. Each letter is squeezed between the first and second belts 3, 2 and is thus forwarded along the conveying system along a main transfer path 100. At least one deflecting flap 51 is able to occupy two positions under the action of a control member, such as e.g. an electromagnet 52. The first or rest position of the flap ensures the uninterrupted advance of the letters along the main transfer path. The second or deflecting position ensures the removal of the letter from the main transfer path 100 towards a discharge transfer path 101, constituted by a belt 4 driven by friction on belt 2 and revolving ahout pulleys P1, P2. When in the deflection position the flap is designated **51*b* and when in the rest position is designated 51*a* in FIG. 1**.

The movement direction of the third belt 4 (arrow f4) is the opposite to that of the second belt 2 (arrow f2). The leading face of the deflected letter is taken up by the third belt 4, which introduces and presses the letter against the stack if the latter has already started to form or, if it is the first deflected letter, presses it directly against pallet 5. A single pallet is shown in order not to make the drawing excessively complicated, but the same number of pallets exist as there are deflecting flaps or stacking paths.

As the stack of letters forms, pallet 5 moves along the translation shaft 6. Pallet 5, sliding on said shaft, actuates an end of travel detector, which controls the inhibition of the box in question, within the sorting programme, in such a way that the machine can continue to sort all the uninhibited stackers. A jamming means 8 ensures the mechanical locking of the pallet in the bottom position.

Figure 2:
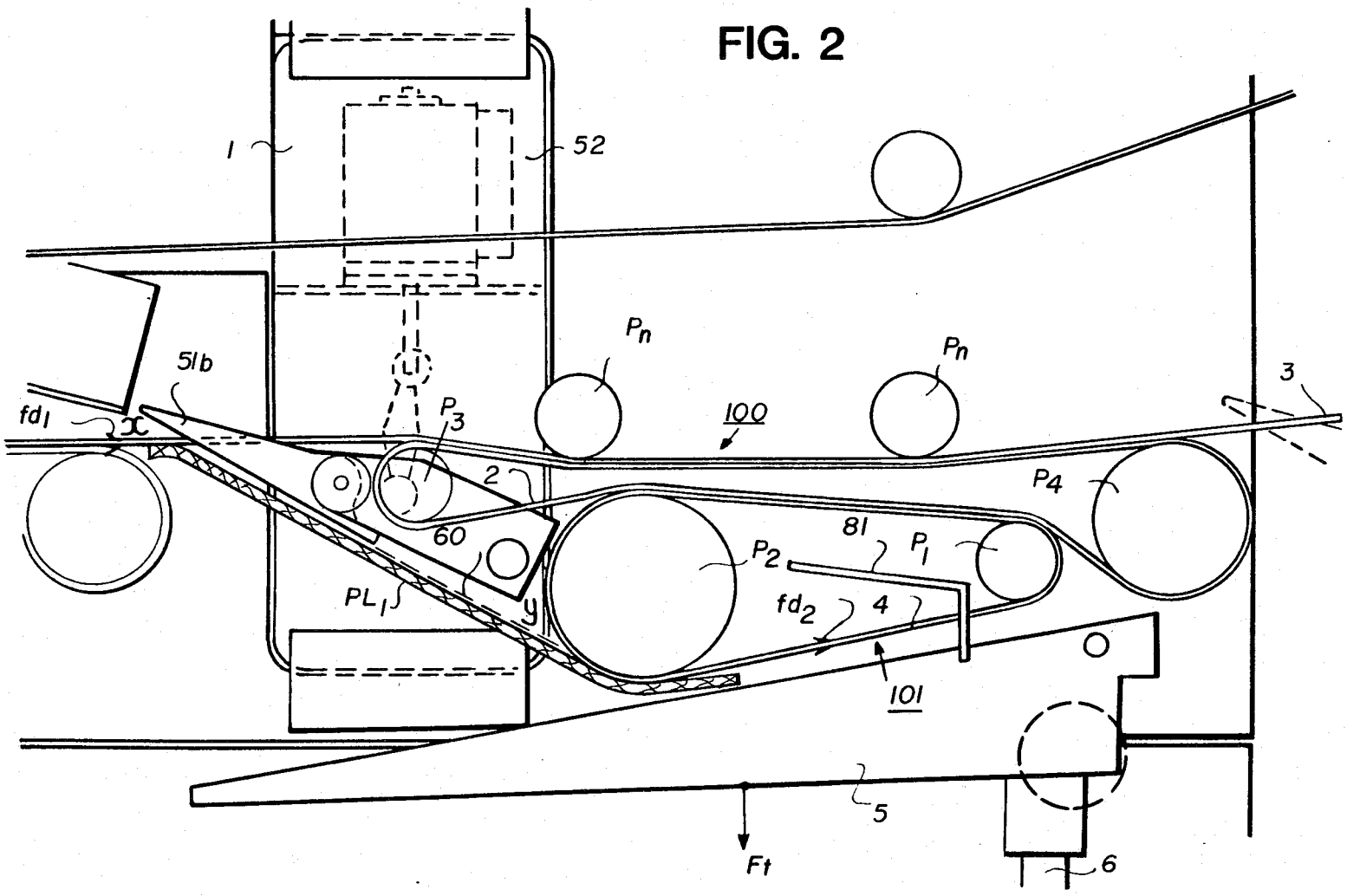
FIG. 2 a diagrammatic representation to provide a better understanding of the apparatus according to the invention.

The operation of the letter deflecting and stacking apparatus will now be explained with particular reference to FIG. 2. The same elements carry the same references as in FIG. 1.

A letter PL1 arriving at flap **51*b*, in which is in the deflection position, is taken up by the deflection transfer path 101 constituted by belt 4. Thus, it leaves the main transfer path 100 constituted by belt 3 and belt 2, as illustrated by arrows $Fd_1$ and $Fd_2$ and slides between belt 4 and the upper face of pallet 5 if stacker 30 is empty and between belt 4 and the letter at the top of the stack if the latter has already started to form. As the letters enter stacker 30, pallet 5 is displaced by translation along shaft 6. Pallet 5 is held in place by a return spring, which is not shown in the drawing. The weight of the stored letters helps it in its translation movement symbolized by arrow Ft towards the bottom of support plate B. The entry of the letters into stacker 30** is assisted by a metal deflector, placed on the plate and enabling the ends of the disengaged letters to be correctly introduced into the stacker.

According to a feature of the invention, the inner face of the flap (x y), namely that permitting deflection in the stacker, is mounted in such a way that it is tangential to the pulley P2 for receiving the letters in the stacker, as indicated by the dotted lines 60. According to another feature of the invention referred to hereinbefore, it is important to note that the letters enter the stacker with a slope of e.g. 23° relative to the vertical plane and that the plane of the support plate 80 is also 23° relative to the horizontal plane. This represents an ergonomic advantage compared with a horizontal stacker by facilitating the gripping by the operator of the stored letters and makes it possible to assist pallet 5 in its translation movement through the action of the force component given by the weight of the stack and the kinetic energy of the last letter entering the stack.

It is also worth pointing out that only one motor means 50 is used for driving belt 3, which drives belt 2 by friction and the latter in turn drives belt 4 in the reverse direction. The latter takes up, slows down and orients the letter towards stacker 30. Belt 2 performs the two functions of the driving by friction of belt 4 and the transfer of the letters into the main path.

A stop plate 81 is provided for stopping the leading face of the letters at the same reference level.

A deflecting and stacking apparatus for letters according to the invention makes it possible to stack all mechanically processed letters, bank or postal cheques, labels, as well as any object squeezed or conveyed between two belts.

What is claimed is:

1. An apparatus for deflecting and stacking postal material as a function of their destination, said apparatus comprising:

means defining a main conveyance path along which said postal material is conveyed in a conveyance direction, said main conveyance path defining means including at least one drive belt means and at least one intermediate belt means, said drive and intermediate belt means being frictionally engaged along a predetermined length thereof to establish therebetween a portion of said main conveyance path;

pallet means defining a planar stacking surface upon which said postal material is stacked and including means to mount said pallet means to permit displacement thereof in a displacement direction in response to the weight of postal material stacked upon said stacking surface;

means defining a deflecting path along which postal material, deflected from said main transfer path, is conveyed in a deflection direction, said deflection path defining means including (a) deflecting means defining a deflecting surface mounted for movement between a rest position wherein said postal material is permitted to be conveyed along said main conveyance path and a deflection position wherein said deflecting surface extends into said main conveyance path to deflect selected ones of said postal material into said deflection path, said deflecting means for deflecting said selected ones into said deflection path and for establishing an upstream portion of said deflection path, (b) deflecting belt means disposed downstream of said deflecting means to establish a downstream portion of said deflecting path, said deflecting belt means for capturing said deflected ones and conveying said deflected ones along said conveyance direction from said upstream portion to said downstream portion, wherein said deflecting belt means includes a first length in frictional engagement with said intermediate belt means to be driven thereby and a second length in confronting parallel relationship to said stacking surface, said second length establishing said downstream portion, and (c) stop means disposed at an end of said downstream portion against which said selected ones contact for stopping the conveyance of said selected ones along said deflection path at a location to form a stack of said selected ones on said stacking surface; and means biasing said pallet to urge the uppermost one of said postal material in said stack against said second length of said deflecting belt means to compress said postal material in said stack against said second section, wherein successive selected ones of said postal material conveyed along said deflection path are stacked between said uppermost one of said postal material in said stack and said deflecting belt means.

2. An apparatus as in claim 1 wherein said stacking surface is angularly oriented relative to horizontal by an angle $\alpha$.

3. An apparatus as in claim 2 wherein said angle $\alpha$ is equal to 23°.

4. An apparatus as in claim 1 wherein said deflecting belt means includes a pair of pulley means around which said deflecting belt means is disposed and between which there are established said first and second lengths, and wherein said deflecting surface defined by said deflecting means establishes said upstream portion such that said upstream portion is tangential to an upstream one of said pulley means when said deflecting means is in said deflecting position.

5. An apparatus as in claim 1 further comprising plural strips of material means arranged parallel to said displacement direction for ensuring sliding of the stack thereagainst.

6. An apparatus mounted on a horizontally inclined support plate for switching and stacking envelopes comprising:

a first drive belt;

a series of second belts opposite to said first drive belt, each said second belt forming a continuous flat loop, said first belt being frictionally engaged with said second belts, said first belt driving said second belts;

an envelope conveying path defined by said first driving belt and at least one said second belt between which are squeezed the envelopes to be conveyed;

a series of controllable flaps, each said flap positioned along said envelope path between a second belt upstream of a said flap and a second belt downstream of a said flap, each said flap controllably moveable between a rest position and deviation position, wherein said conveying path is uninterrupted and remains continuous when a flap is in said rest position whereas an envelope is deviated from said conveying path when a flap is in said deviation position;

a series of third belts, each said third belt associated with a flap upstream thereof, each said third belt frictionally engaged with an associated second belt downstream of the flap;

a series of pallets, each said pallet positioned in confronting relationship to a respective third belt, each said pallet being biased towards a said respective third belt whereby successive envelopes are stacked in said pallet when said successive envelopes are deviated from said envelope path when said associated flap upstream from said respective third belt is controllably moved to a deviation position.

* * * * *